US008365713B2

(12) United States Patent
Grace, Jr.

(10) Patent No.: US 8,365,713 B2
(45) Date of Patent: Feb. 5, 2013

(54) BOWSTRING SUPPRESSOR

(75) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 338 days.

(21) Appl. No.: 12/817,419

(22) Filed: Jun. 17, 2010

(65) Prior Publication Data

US 2010/0319669 A1 Dec. 23, 2010

Related U.S. Application Data

(60) Provisional application No. 61/218,608, filed on Jun. 19, 2009.

(51) Int. Cl.
*F41B 5/20* (2006.01)

(52) U.S. Cl. ..... 124/89

(58) Field of Classification Search ..... 124/23.1, 124/25.6, 86, 88, 89, 90, 91, 92
See application file for complete search history.

(56) References Cited

U.S. PATENT DOCUMENTS

| | | | | |
|---|---|---|---|---|
| 4,061,125 | A | 12/1977 | Trotter | |
| 4,146,009 | A * | 3/1979 | Adams | 124/88 |
| 4,461,267 | A | 7/1984 | Simonds et al. | |
| 5,720,269 | A | 2/1998 | Saunders | |
| 6,283,109 | B1 * | 9/2001 | Wiseby et al. | 124/89 |
| 7,721,724 | B2 | 5/2010 | Goade | |
| 8,109,261 | B2 * | 2/2012 | Grace, Jr. | 124/91 |
| 2003/0056779 | A1 * | 3/2003 | Gallops, Jr. | 124/89 |
| 2006/0278207 | A1 | 12/2006 | Goade | |
| 2008/0236559 | A1 | 10/2008 | Barnard | |
| 2008/0264400 | A1 * | 10/2008 | Wright | 124/89 |
| 2009/0000606 | A1 | 1/2009 | Cooper et al. | |
| 2009/0014239 | A1 | 1/2009 | Mancini | |

OTHER PUBLICATIONS http://www.paradigmarchery.com, downloaded Jun. 3, 2010.

* cited by examiner

*Primary Examiner* — John Ricci
(74) *Attorney, Agent, or Firm* — Warner Norcross & Judd LLP

(57) ABSTRACT

A bowstring suppressor for an archery bow including a suppressor assembly and/or a bowstring attachment element. The assembly can include a housing within which resilient elastomeric elements are located. A push rod can be telescopically joined with the housing and located near the resilient elements. An engagement element can be joined with the push rod and can be engaged by a bowstring when an arrow is shot from the bow. The push rod can move toward the resilient elements and compress them when the bowstring engages the engagement element. Compression of the resilient elements provides energy absorption, vibration absorption and/or dampening in relation to energy generated by the bow. A string attachment element can be joined with the bowstring and can engage the suppressor assembly, with the attachment element seating in and optionally deforming the engagement element, which in turn, restrains lateral and vertical movement of the bowstring.

20 Claims, 6 Drawing Sheets

BOWSTRING SUPPRESSOR

This application claims priority benefit of U.S. Provisional Application 61/218,608, filed Jun. 19, 2009, which is hereby incorporated by reference.

BACKGROUND OF THE INVENTION

The present invention relates to archery equipment, and more particularly to a suppressor and/or limiter for bowstrings of archery bows.

Conventional archery bows, such as compound archery bows, include a riser and a pair of opposing limbs. Between the limbs, a bowstring and one or more cables, usually an up cable and a down cable are strung. The cables generally transfer energy from the limbs and respective cams or pulleys, to the bowstring, and thus to an arrow shot from the bow. A compound bow, by design, creates a significant amount of energy to rapidly propel an arrow to its target. Even after the arrow is released, however, a portion of that energy remains in the bow, primarily in the bowstring, usually leaving the bowstring in a state of movement. That energy typically translates to movement and noise, with the movement in the form of string oscillation. This oscillation can cause undesirable vibration and hand shock to an archer shooting the bow.

One approach to addressing oscillation uses devices attached to the bowstring. These devices are generally made of a resilient material, such as rubber, and are intended to absorb string vibrations. The devices are "tuned" to maximize their vibration dampening effect by moving them up and down the string until an optimum location is achieved.

Another approach to addressing undesired bowstring oscillation implements a rigid rod, having one end that attaches to the riser of the bow, and an opposite end which faces the bowstring. The opposite end typically includes a resilient material. Upon release of the bowstring, the bowstring moves forward and contacts the resilient material. In turn, the resilient material restricts forward movement of the bowstring toward the riser and shortens the period of vibration.

More recent modifications of the above construction include a hollow tube that attaches at one end to the riser of the bow. A solid cylindrical rod interfits telescopingly in the hollow tube, and projects from the other end of the tube. The solid rod includes a resilient cap on an end that is adapted to engage the bowstring in the manner noted in the construction above. The cylindrical rod can be adjusted so that the rod and tube collectively form a desired length to properly engage the bowstring. After the desired length is achieved, the rod is held in place relative to the tube with screws projecting through the sidewalls of the tube to engage the rod so that the rod remains stationary when the bowstring strikes the cap.

Another modification of the above construction implements a resilient closed cell foam cylinder that generally forms a hollow tube. Encapsulated inside the foam cylinder is a plunger that adds rigidity to the foam. The plunger is positioned in a hollow tube, which is attached to the bow riser. When the bowstring is released, it contacts an end of the foam cylinder. As the foam cylinder collapses, it is restricted in its forward movement by the foam cell compressing and the plunger sliding in the shaft.

Another approach to the constructions above includes a hollow tube that is attached at one end to a bow riser. A push rod is mounted in the hollow tube, and projects from the other end of the tube. The rod includes a resilient cap on an end that is adapted to engage the bowstring in the manner noted in the construction above. Inside the hollow tube a 302 stainless steel coil spring is located. Upon release of the bowstring, the bowstring moves forward and contacts the resilient material. In turn, the push rod engages the steel coil spring.

Although the above designs suppress string vibration and/or limit bowstring movement to some degree, there remains room for improvement with regard to such archery equipment.

SUMMARY OF THE INVENTION

A bowstring suppressor assembly and a bowstring attachment element are provided. The suppressor assembly can engage the bowstring and dampen vibration and/or limit or impair movement of the bowstring. The bowstring attachment element can join with a bowstring and can control bowstring movement upon impact of the bowstring relative to a suppressor assembly. The bowstring suppressor assembly and bowstring attachment element can be used alone or in combination with one another.

In one embodiment, the suppressor assembly includes a housing that houses at least one energy absorbing, dampening and/or resilient element, and a mounting element that joins the assembly to a riser or other component of a bow. The assembly also can include a push rod that translates bowstring movement to the resilient element, and an engagement element which the bowstring directly or indirectly engages. Optionally, the suppressor assembly can include a bushing interface between the housing and the push rod to reduce friction, as well as a retaining element at a front end and a cap at the opposite end near the bowstring.

In another embodiment, the bowstring attachment element can include a string member joined with the bowstring and aligned with the engagement element of the suppressor assembly. This engagement element can define a recess or hole facing the bowstring. The engagement element can be joined with the push rod of the suppressor assembly. The string member can be sized to at least partially enter and be partially located in the recess or hole defined by the engagement element. Optionally, the string member can be spherical in shape, and the recess or hole can be generally cylindrical, concave, conical and/or frustoconical in shape. The engagement of the string member and resilient engagement element can laterally and longitudinally control movement of the bowstring when it impacts the suppressor assembly.

In another embodiment, the suppressor assembly and the optional string attachment work in concert. For example, when the bowstring moves forward after its release from a drawn state, the bowstring attachment element engages the resilient engagement element, which can be located on the rearmost end of a push rod of the suppressor assembly. In turn, this can restrict both the lateral (side to side relative to the bow) and vertical (up and down relative to the bow) movement of the bowstring. At least a portion of this movement further translates to a forward motion of the push rod. This forward motion of the push rod can compress the internal resilient elements of the suppressor assembly. This can provide the energy absorption, vibration absorption and/or dampening, and can also limit the forward travel of the bowstring.

In yet another, embodiment, the housing of the suppressor assembly can be constructed of rigid material, for example metal or composite, in the form of a tube. The front of the tube can include a mounting stud configured to mount the suppressor assembly to a bow riser or to a stock of a crossbow. The rear of the housing can define a bore of reduced size to accept the push rod and optionally a bushing for the push rod. Further optionally, the housing can define a bore or cavity in which the resilient elements are located. The bore can be sized and shaped to fit the resilient elements as well. For example, if the resilient elements are generally spherical, the bore can be of a circular cross section and sized to house the resilient elements therein.

In still another embodiment, the push rod can be constructed in a solid or tubular configuration. A front end of the push rod can include a retainer element that retains the rod in the housing bore. The retainer element can include a concave or frustoconical surface adapted to contact the rearmost of the resilient elements.

In still yet another embodiment, the opposite end of the rod can be configured to fit the engagement element, describe above, which optionally can be in the form of a resilient cap that partially absorbs the impact of the bowstring.

Where used, the suppressor assembly provides a simple and efficient construction that engages the bowstring to dampen vibration and/or limit or impair movement of the bowstring. Further, where used, the bowstring attachment element can join with a bowstring and can control bowstring movement upon impact of the bowstring relative to the suppressor assembly. With either or both of the aforementioned items, an archery bow can be made to shoot an arrow more efficiently and accurately, and can transfer less vibration and shock to an archer's hand.

These and other objects, advantages, and features of the invention will be more fully understood and appreciated by reference to the description of the current embodiment and the drawings.

DETAILED DESCRIPTION OF THE CURRENT EMBODIMENTS

I. Overview

Figure 1:
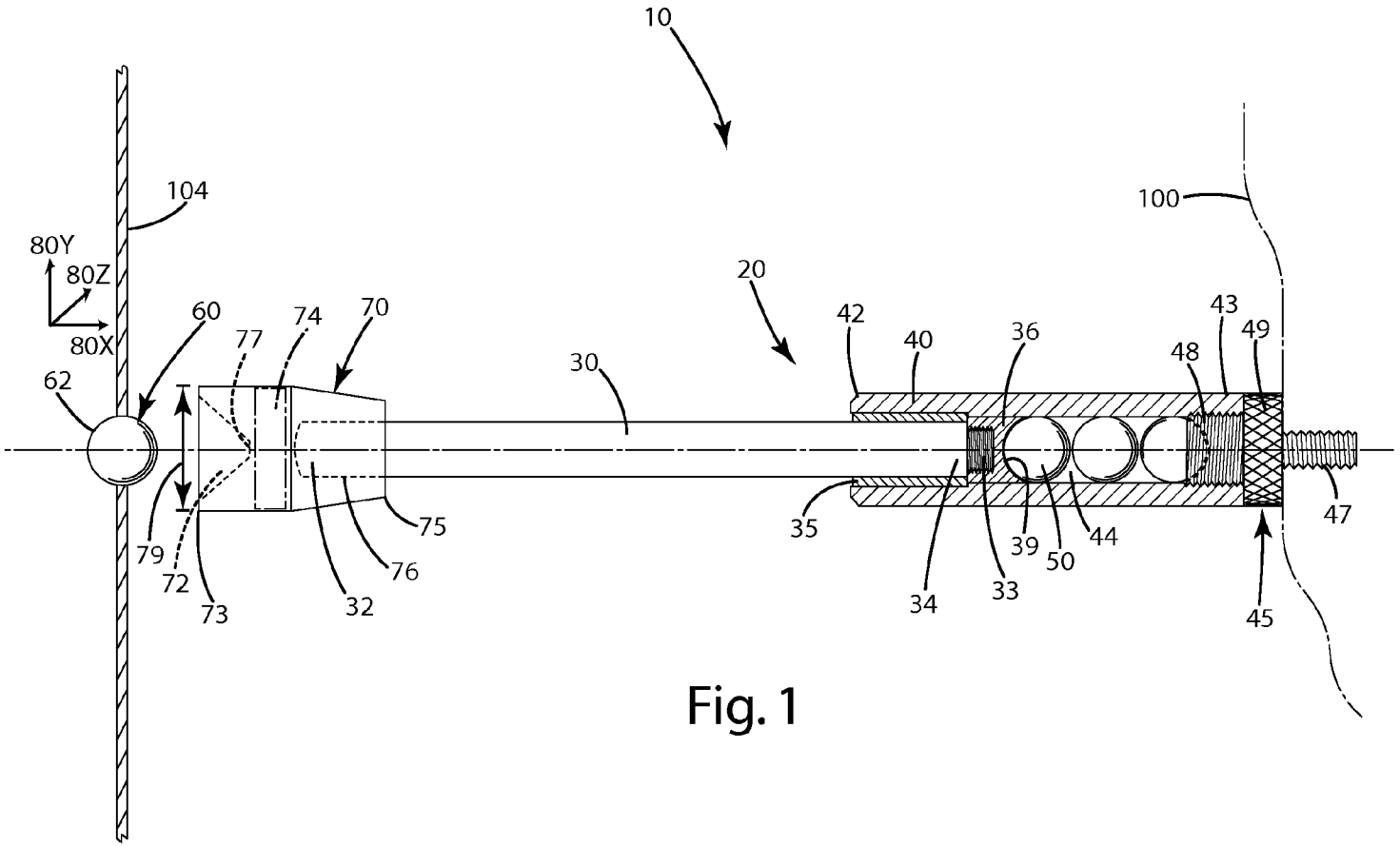
FIG. 1 is a partial sectional side view of current embodiments of the suppressor assembly and the bowstring attachment element with a bowstring of a bow at rest, and with resilient elements in an uncompressed mode.
Figure 2:
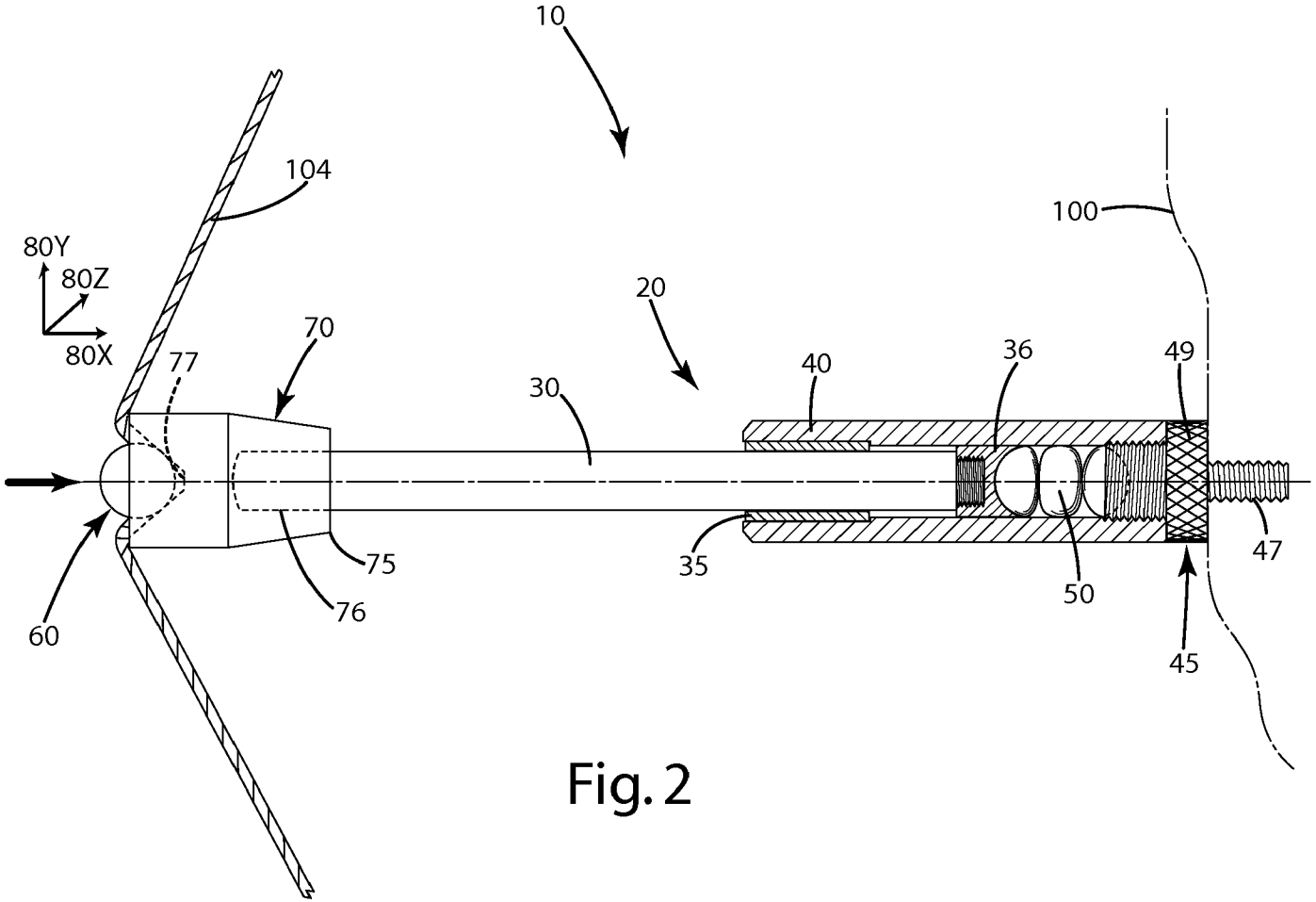
FIG. 2 is a partial sectional side view of the suppressor assembly and the bowstring attachment element with the with a bowstring of the bow moving, and with resilient elements in a compressed mode.

A current embodiment of the bowstring suppressor, including a suppressor assembly and string attachment element, is illustrated in FIGS. 1 and 2 and generally designated 10. The suppressor assembly 20 is attached to an archery bow, and in particular an archery bow riser 100. In general, the suppressor assembly 20 provides vibration absorption, dampening and/or energy absorption caused as and/or after an arrow disengages the bowstring when the arrow is shot from the archery bow. The bowstring attachment element 60 includes a body 62 joined directly with the bowstring 104 to provide control over the direction and extent of the bowstring movement.

The embodiments of the bowstring suppressor are well suited for single cam compound archery bows, dual cam bows, cam and a half bows, recurves, longbows, crossbows and other archery systems including a bowstring.

II. Construction

The bowstring suppressor 10 can include a suppressor assembly 20 and a bowstring attachment element 60, used alone or in combination with an archery bow 100. In general, the suppressor assembly 20 can include a push rod 30, a housing 40 and resilient elements 50.

The push rod 30 can be constructed of a rigid material, optionally metal, further optionally steel. Of course, other materials such as carbon fiber, fiberglass or graphite can be used as desired. The push rod can be of any geometric cross section, for example, it can have a circular, elliptical, rectangular, triangular hexagonal or other cross section. As shown, however, the push rod is generally of a cylindrical shape. Further, the push rod can be solid or hollow and tubular, depending on the application.

The push rod 30 can be configured to telescopically move in relation to the housing 40. For example, the push rod can be configured to at least partially fit within the housing, and move into and out from it when acted upon by outside forces. Alternatively, the push rod can fit around at least a portion of the housing so that the housing fits at least partially within the push rod.

As shown in FIG. 1, the push rod includes a first push rod end 32 and a second push rod end 34, which is located near the resilient elements 50. If desired, the push rod, for example, the second push rod end, can directly engage the resilient elements, or can be located a small distance away from them, and/or separated by another component, and still be considered proximal to those resilient elements 50. The push rod 30 can slide freely in an optional low friction bushing 35 pressed into, screwed on or in, or otherwise joined with the second housing end 42. The optional bushing 35 can be constructed from a low friction material such as a low friction polymer, a high density polyethylene, a material known as Delrin™, or any other material as desired.

The second end 34 of the push rod can include an optional retainer element 36. This retainer element 36 can assist in keeping the push rod joined with the housing 40. For example, the retainer element 36 can abut against or otherwise engage a projection on the inside of the housing that acts as a stop for the retainer element, preventing the push rod 30 from being easily removed from the housing 40. Alternatively, the bushing 35 can be configured to abut against or otherwise engage the retainer element 36 to prevent the push rod 30 from being easily removed from the housing.

The retainer element 36 can be joined with the push rod 30 in a variety of manners. For example, the retainer element 36 can be integrally formed with the push rod 30. As another example, the retainer element can define a thread for attachment to a matching thread 33 of the push rod. The retainer element 36 and push rod alternatively can be glued or fastened with other fasteners to one another.

Optionally, the retainer element or the second end 34 of the push rod can include a contact portion 39 that contacts one or more of the resilient elements 50. The contact portion 39 can correspond in shape with the resilient element that it contacts. For example, where the resilient element is spherical, the contact portion can include a concave partially spherical shape. Further optionally, if the resilient elements are conical or square, the contact portion can have a conical recess or flat contact portion, respectively. Even further optionally, the contact portion can be of a different shape than the resilient members, for example, the contact portion can be flat, while the resilient members are spherical.

As shown in FIGS. 1 and 2, the push rod 30 also can be joined with an engagement element 70 opposite the housing 40, for example, at the first end 32 of the push rod, adjacent the string, so that the engagement element can engage the bowstring when an arrow is shot from the bow as describe below.

The suppressor assembly 20 also can include a housing 40. This housing can be of a variety of geometric shapes in cross section. For example, as shown, the housing can be a rigid hollow cylinder constructed from metal such as aluminum, or optionally a composite material such as graphite, plastic or other polymers. The housing 40 can define a bore 44 extending from a first housing end 42 to a second housing end 43. As shown in FIG. 1, the housing bore 44 can be of a size and shape that at least partially correspond to the size and shape of the resilient elements 50. Optionally, as illustrated, the bore 44 can be sized for a major portion of its length for a light friction fit to the free state (uncompressed) diameter or maximum dimension of the resilient elements 50.

The push rod 30 can extend from the first housing end 42, while the second housing end 43 can be configured for mounting to the riser of the archery bow. For example, the second housing end 43 can join with a mounting stud 45, with an internal thread being provided at the second housing end 43 to accept the matching external thread 48 of the mounting stud 13. The mounting stud 45 can further include a threaded portion 47 that is designed to engage the bow riser 30. Alternatively, the portion 47 can be provided with a smooth cylindrical boss for application to a riser 30 having a smooth bore. Of course, if desired, the mounting stud 45 can be adjustable to enable the housing 40 to be mounted in a variety of configurations relative to the riser and/or the bowstring.

The mounting stud 45 can be constructed of metal, for example aluminum, or a composite or polymer as desired. Optionally, the outer surface 49 of the mounting stud 45 can be knurled for ease of assembly. Further optionally, the mounting stud 45 can include a contact portion 48 that contacts or otherwise engages the resilient members 50. This contact portion 48 can be flat, or convex, or it can include a geometric shape that corresponds to the geometric shape of the resilient members as described in connection with the retainer element above. Optionally, the contact portion can generally centers the resilient elements 50 in the housing, even when the resilient elements undergo compression as shown in FIG. 2.

The suppressor assembly 20 also can include resilient elements 50. As shown in FIGS. 1-2, the resilient elements 50 can be located between the housing ends 42 and 43, optionally within the internal bore 44 of the housing. The resilient elements generally can be in the shape of spheres, but of course, other geometric shapes can be used as well. For example, other suitable shapes include elliptical, square, rectangular, conical, rounded and trapezoidal shapes. The resilient elements can provide a major portion of the vibration absorption, energy absorption and/or dampening of the bowstring, and more generally, in relation to energy generated by the bow when an arrow is shot from the bow.

The resilient elements 50 can be manufactured from a variety of materials, and can be of a desired density and uniformity. Specific examples of vibration absorbing, energy absorbing and/or dampening materials include elastomeric materials and polymers including, but not limited to, rubber, elastomeric rubbers, elastic and vinyl polymers, rubber copolymers, polyurethane, e.g., Navcom™ (available from Allsop/Sims Vibration of Bellingham, Wash.), or viscoelastic rubber such as Smactane®, Smacsonic® (available from SMAC of Banly, France), ethylene-propylene diene rubbers, chlorinated rubbers, nitrile rubbers, methylmethacrylate styrene-butadiene block copolymers, polybutadiene, acrylonitrile-butadiene-styrene copolymers, rubber acrylic polymers, silicone, combinations of the foregoing, and the like. When the resilient elements are constructed from any of the foregoing materials, alone or in combination, the resilient elements generally can be referenced as resilient elastomeric elements.

The resilient elements 50 can be shaped and sized for a slip fit into the housing internal bore 44 when the elements are not under compression or other forces. Optionally, the largest dimension of the resilient elements 50 can be slightly smaller than the smallest dimension of the bore 44. The resilient elements can be of a specified hardness and/or density that will allow them to distort in a controlled manner under compression. This distortion can increase their resistance to sliding in the housing bore 44, thereby providing additional vibration absorption, energy absorption and/or dampening effect.

Although the illustrated embodiment of the suppressor assembly 20 is shown as including a push rod 30 and housing 40 that move relative to one another, the suppressor assembly can be constructed so that it includes no moving parts. For example, the suppressor assembly can include a rod having an engagement member attached to one end of the rod, with the other end of the rod rigidly threaded into or otherwise secured to the riser 100 of the bow.

Figure 3:
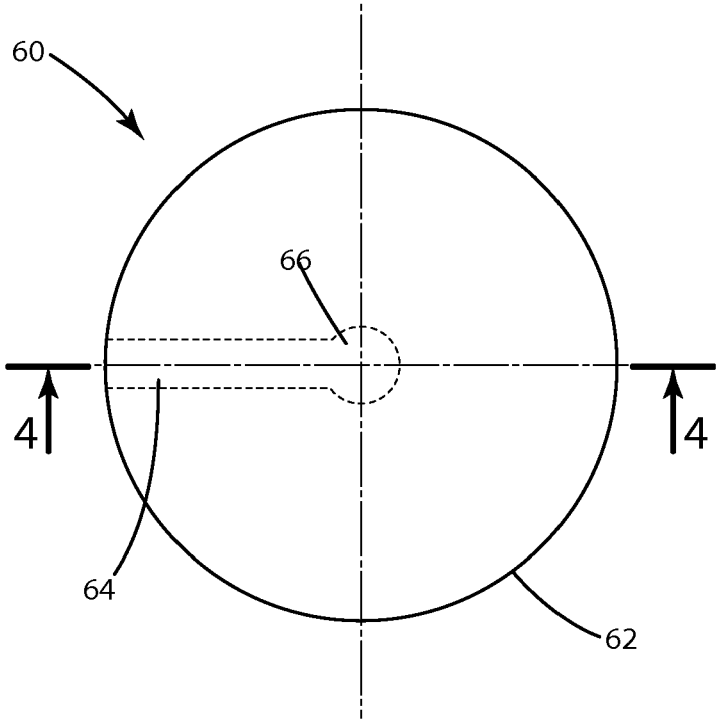
FIG. 3 is a top view of the bowstring attachment element.
Figure 4:
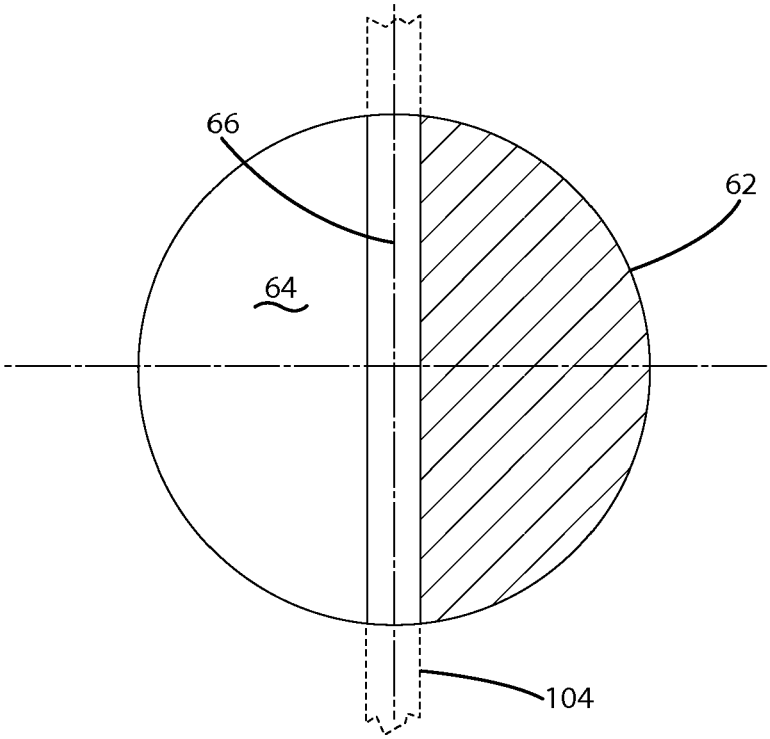
FIG. 4 is a sectional side view of the bowstring attachment through line 4-4 of FIG. 3.

With reference to FIGS. 3 and 4, the suppressor 10 can also include a string attachment element 60, which can act in concert with an engagement element 70 of the suppressor assembly 20. As illustrated, the string attachment element 60 can include a body 62 that is spherical in shape, or of some other geometric shape as desired, and can be manufactured from any number of materials, such as those presented above in connection with the resilient elements. The body 62 can define a slot or recess 64 that generally terminates at a cylindrical bore 66. This bore 66 can be coaxial with the diameter of the sphere. The bowstring 104 can be positioned in the bore 66 as desired. Where constructed from a resilient material, the resilient nature of that material can permit the insertion of the bowstring 104 in the slot 64 and its ultimate retention in the bore 66 when the desired location along the bowstring 104 is achieved. Optionally, the body can be further attached to the string 104 with a serving, or a fastener passing through the body to close off the slot 64. Further optionally, the dimension of the body 62, for example, the diameter of the body when it is a sphere, can be proportioned to fit the recess or depression 72 defined at the rear 32 of the engagement element 70.

The engagement element 70 can be constructed from any number of materials, such as those presented above in connection with the resilient elements, and can be joined with the second end of the push rod 10. To connect the engagement element to the push rod, the element 70 can define a hole or recess 76 into which the push rod 30 is inserted. If desired, the element 70 can be glued to the rod, molded directly to the rod, or otherwise secured to the push rod.

The engagement element 70 can also define a recess, hole or depression 72, which as illustrated, can be of conical shape. Of course, the recess can be of other shapes, such as concave, conical, frustoconical, pyramidal, trapezoidal, cylindrical and other geometric configurations. The recess 72 can be configured to deform when the string attachment element 60 seats within it, or otherwise engages it upon the bowstring being released where shooting an arrow. As explained in further detail below, the seating of the string attachment element 60 at least partially within the engagement element 70 at least partially restrains lateral and vertical movement of the bowstring, which in turn can absorb vibration and otherwise absorb energy when the bow is shot.

The engagement element 70 can be configured so that the recess is formed in a first end 73 of the engagement element and includes a bottom 77. On the opposite end 75 of the engagement element, that element can define a bore 76 into which the rod is inserted or is otherwise positioned. Between the bore 76 and the bottom of the recess 77, the engagement element can include a central portion 74 which can be of a solid cross section. Within this cross section, the engagement element optionally includes no voids connecting the recess 72 and the bore 76. Accordingly, the engagement element can be generally non-tubular. Furthermore, the dimension 79 of the engagement element as illustrated can be generally the same in transitioning from the central portion section 74 of the engagement element. Further, the recess 72 defined by the engagement element can be contained within the generally continuous and consistent dimension 79. In this manner, the rearward portion of the engagement member needs not be flared outward or otherwise extend outwardly beyond the remainder of the engagement element 70. Of course, if desired, the construction could be modified so that the portion of the engagement member adjacent the recess does flare outwardly if desired.

III. Method of Manufacture and Operation

A method of making the current embodiment of the suppressor assembly 20 and string attachment element 60 will now be briefly described. In general, the housing 40, push rod 30, the retainer element 36 and mounting stud 45 can be formed using machining and/or molding techniques from metals, composites or other desired materials. The resilient elements 50, engagement element 70 and string attachment element 60 can be molded or otherwise formed using the materials that are identified above.

To assemble the suppressor assembly 20, the bushing 35 can be inserted or press fit into the internal bore 44 of the housing. The push rod 30 can be joined with the engagement element 70 by gluing the engagement element 70 to the end 32 of the rod. The rod 30 can be inserted through the bushing and generally through the housing 40. The retainer element 36 can be screwed onto the second end 34 of the push rod. The push rod 30 can then be adjusted so that the retainer element 36 seats against the bushing 35. One or more resilient members 50 can then be inserted into the bore 44 of the housing. With the resilient members fully inserted, the mounting stud 45 can be joined with the first housing end 43. With the suppressor assembly 20 assembled, it can be joined with the riser 100 of an archery bow, for example, by threading the portion of the mounting stud 45 into the riser.

The string attachment element 60 can be molded from any of the materials described above in connection with the resilient elements 50. After being formed, the string attachment element 60 can be joined with a bowstring 120 by sliding it over the bowstring so that the bore 66 is generally coaxial with the bowstring. The body 62 of the string attachment element further can be served or fastened to the bowstring using conventional techniques. Generally, the string attachment element is positioned on the bowstring so that it aligns with the recess 72 of the engagement element 70 when the suppressor assembly 20 is also installed on the bow.

The operation of the suppressor 10, and in particular, the suppressor assembly 30, will now be described. In general, in an uncompressed state, or slightly compressed state, each resilient element 50 can be in point contact with an adjoining resilient element and/or the concave surfaces of the push rod retaining element 36 and/or the contact portion 48 of the mounting stud 45. Additionally, in the uncompressed or slightly compressed state, each resilient element 50 can be in line contact about at least a portion of its circumference with the interior surface of the bore 44 of the housing 40.

When the bowstring is drawn and then released, it and/or the string attachment element if included engages the engagement element 70, which causes the push rod 30 to move toward the housing. As the push rod 30 moves forward through the action of the bowstring, it at least partially compresses one or more of the resilient elements 50 as shown in FIG. 2, which increases the surface contact with adjacent resilient elements, as well as the interior surface of the bore 44 of the housing 40. The resultant increase in friction can subsequently absorb dampen the vibration and/or energy imparted by or to the bowstring 104 in the process of shooting the arrow.

Further, where included, the concave inner surfaces of the push rod retainer element 36 and the mounting stud 45 can assist in maintaining the centrality of the resilient elements 50 as they are compressed. After the vibration and energy dissipates, the push rod moves outward relative to the housing, to a generally extended state as shown in FIG. 1. The resilient members also return to their uncompressed or slightly compressed state within the internal bore 44 of the housing 40.

The operation of the string attachment element 60 of the suppressor 10 will now be described. In general, the string attachment cooperates with the engagement element 70 to limit movement of the bowstring. For example, when the bowstring 104 moves forward upon its release, the string element body 62 impacts the engagement element 70, and at least partially seats within the recess 72. The body 62 seating or otherwise engaging the recess 72 and/or engagement element 70 can cause the recess and/or engagement element to deform slightly, aligning and partially restricting the movement of the bowstring 104 by trapping the bowstring 104 on the diametrically opposed edges of the engagement element 70. The engagement of the string element 60 and the engagement element 70 can effectively trap the string element 60 within the engagement element 70. By doing so, movement of the bowstring longitudinally along the string, and laterally, side to side, as well as forward and away from the housing 40 can be impaired and/or significantly restricted or limited.

Optionally, as shown in FIGS. 1 and 2, the movement of the string in and on the axes 80X, 80Y and 80Z, as well as any axes therebetween, can be restricted, limited or impaired by the engagement of the string attachment element 60 within the recess 72. Accordingly, the movement of the string in any of the aforementioned directions can be focused along the axis of the push rod to enhance energy absorption, vibration absorption, and/or dampening by the suppressor assembly. And as mentioned above, the impact of the bowstring 104 and string attachment element 60 on the engagement element 70, and thus on the end of the push rod 30, translates to the forward movement of the push rod 30 and subsequent compression of the resilient elements 50 described above.

IV. First Alternative Embodiment

Figure 5:
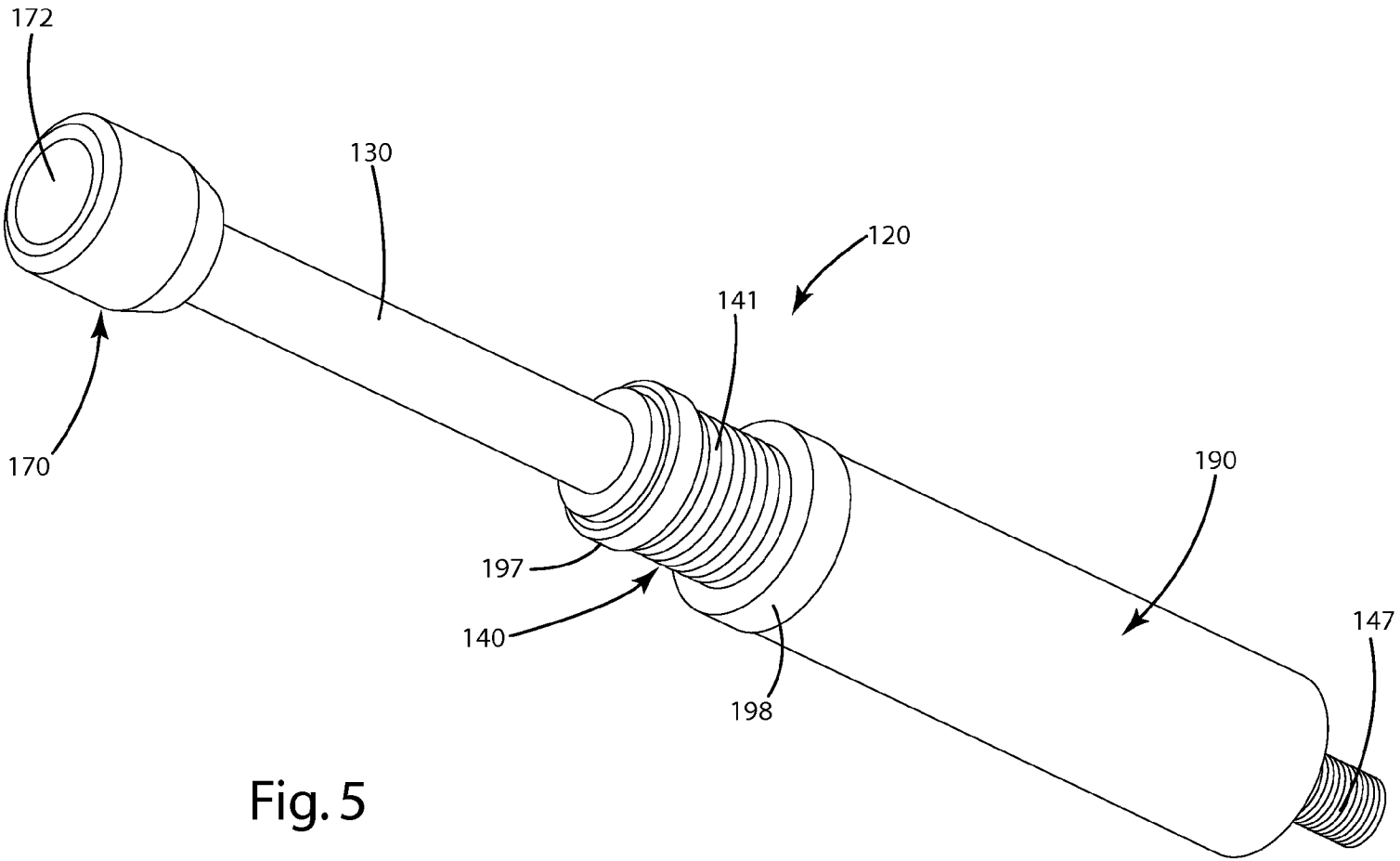
FIG. 5 is a perspective view of a first alternative embodiment of the suppressor assembly.

A first alternative embodiment of the suppressor assembly 120 will now be described with reference to FIGS. 5-7. This embodiment is generally the same as the current embodiment above with several exceptions. For example, a mounting element 190 is provided for adjusting the length of the suppressor assembly 120 body to accommodate differences in brace height, thereby making it even more suitable as a customizable aftermarket accessory for a variety of bows from different manufacturers.

Figure 6:
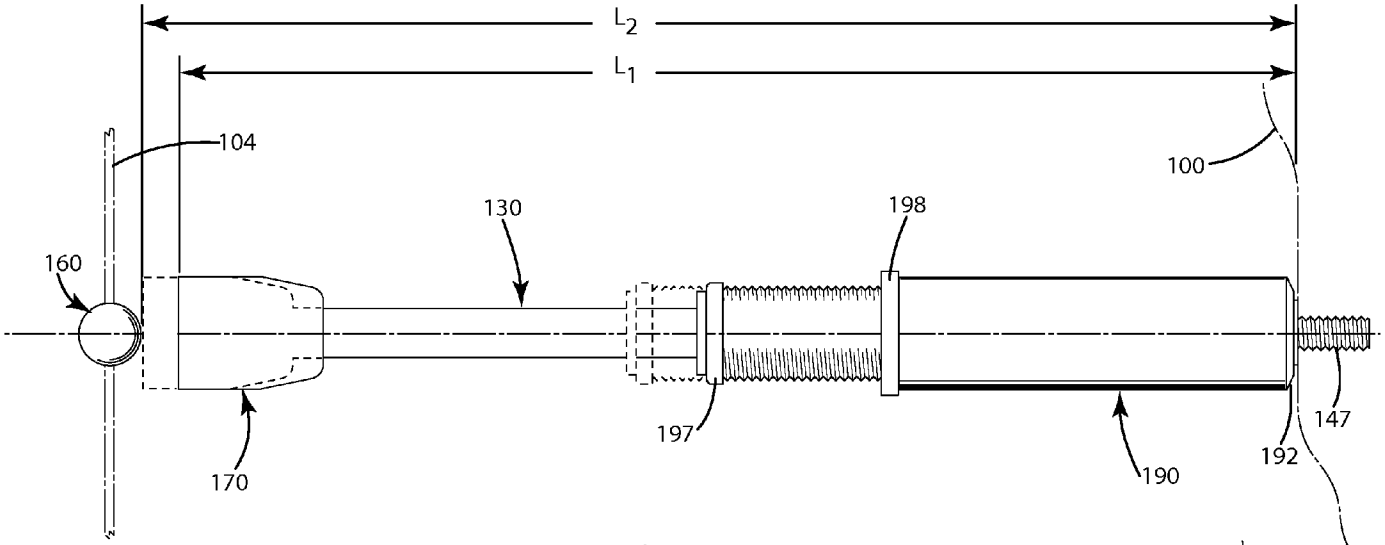
FIG. 6 is a side view of the first alternative embodiment of the suppressor assembly, illustrating the length adjustability of that embodiment with a bowstring of the bow at rest.
Figure 7:
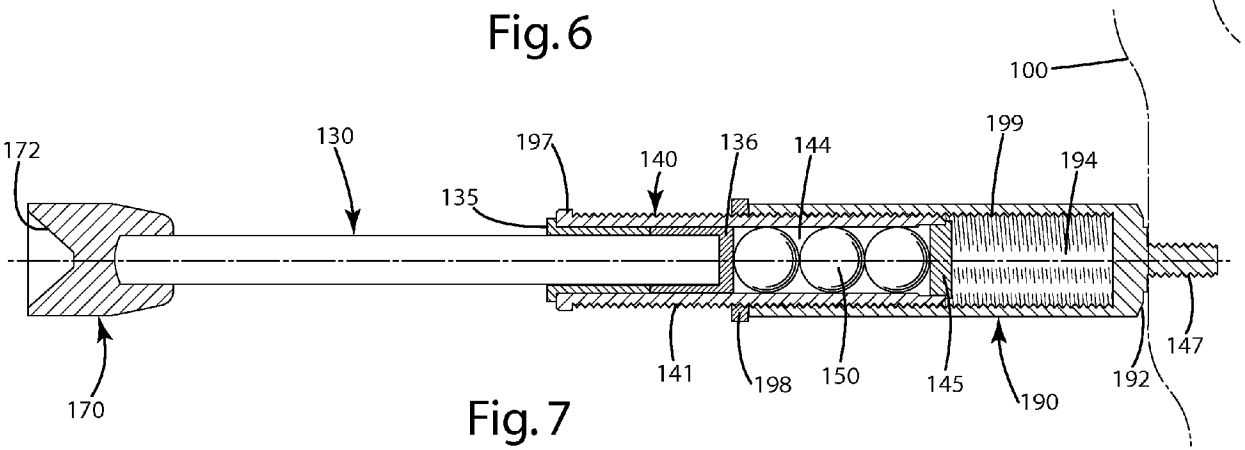
FIG. 7 is a sectional view of the first alternative embodiment of the suppressor assembly and the bowstring attachment element with a bowstring of the bow at rest, with resilient elements in an uncompressed mode.
Figure 8A:
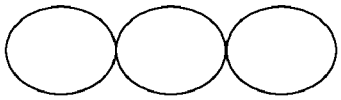
FIGS. 8*a*-8*f* are side views of elliptical, square, rectangular, conical, rounded and trapezoidal shaped resilient elements that can be used with the suppressor assembly.
Figure 8B:
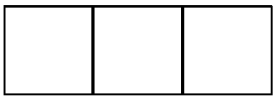
Figure 8C:
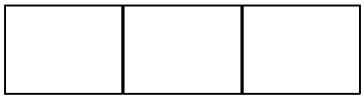
Figure 8D:
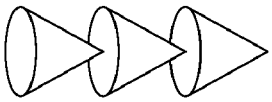
Figure 8E:
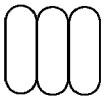
Figure 8F:
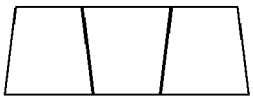

With reference to FIGS. 6 and 7, the suppressor assembly 120 can include a housing 140 and a mounting element 190. The housing 140 generally fits within a portion of the mounting element 190 to form a two-piece suppressor assembly body. The housing 140 can include an external thread on a portion of its outer surface 141. This threaded surface 141 can engage a corresponding internal threaded portion on the inner surface 199 of the mounting element 190. The housing also can include a cap or end element 145 which closes off the internal bore 144 of the housing in which the resilient elements 150 are located, as in the embodiment above.

The mounting element 190 can be in the form of a tube of a similar geometric cross section as the housing. As illustrated, the mounting element is generally cylindrical, and includes a forward end 192 that is generally closed, and provided with an optional threaded boss 147 for attachment to the riser of the bow 100. The mounting element 190 can enclose a volume or bore 194 into which the housing 140 is positioned and adapted to be moved, but fixed after a desired length of the suppressor assembly is achieved.

The housing 140 can include an optional knurled portion 197 at an end to assist in threading the housing 140 relative to the mounting element 190 in adjusting the length of the suppressor assembly. For example, with reference to FIG. 7, engaging the threaded surface 141 and 199, of the respective housing and mounting element 190 selectively moves the housing 140 relative to the mounting element 190 to adjust the length of the suppressor assembly from L1 to L2. The length L can be generally fixed by joining the housing and the mounting element in a fixed spatial relationship relative to one another. This can be achieved by using a locking element 198. One suitable locking element 198 as illustrated is a jam nut, the outer surface of which can be optionally knurled or fitted with wrench flats. Of course, the jam nut can be replaced with a variety of other fasteners, set screws or constructions that can fix the spatial relationship of the housing and the mounting element to adjust the length of the suppressor assembly, which again, generally can correspond to the brace height of the bow to which the suppressor assembly is attached.

The other components of the suppressor assembly of the first alternative embodiment can be similar in construction and operation to those described in connection with the embodiments above.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A bowstring suppressor for an archery bow comprising:

a suppressor assembly adapted to be joined with an archery bow, the suppressor assembly including:

a housing defining an internal bore and including a first housing end and a second housing end;

a plurality of resilient elements positioned adjacent one another in the bore, each resilient element at least partially engaging the bore, the plurality of resilient elements being located between the first housing end and the second housing end;

a push rod telescopically joined with the housing, the push rod including a first push rod end and a second push rod end, the second push rod end being located proximal at least one of the plurality of resilient elements and being and adapted to move toward the plurality of resilient elements and to compress the plurality of resilient elements; and an engagement element defining a recess adapted to face a bowstring of the archery bow, the engagement element joined with the first push rod end, the engagement element adapted to be engaged by the bowstring;

a string attachment element joined directly with the bowstring, the string attachment element aligned with the engagement element so that when the archery bow is shot, the string attachment element engages the suppressor assembly, at least partially seats within the engagement element and at least partially deforms the engagement element, wherein the seating of the string attachment element at least partially within the engagement element at least partially restrains lateral and vertical movement of the bowstring, wherein engagement of the string attachment element and the suppressor assembly moves the push rod relative to the housing to at least partially compress at least one of the plurality of resilient elements, whereby compression of the at least one of the plurality of resilient elements provides at least one of energy absorption, vibration absorption and dampening in relation to energy generated by the bow when shooting an arrow from the bow.

2. The bowstring suppressor of claim 1 wherein the plurality of resilient elements are each of a geometric shape, the shape being at least one of spherical, elliptical, square, rectangular, conical, rounded and trapezoidal shapes.

3. The bowstring suppressor of claim 1 wherein the plurality of resilient elements are spherical in shape and wherein the internal bore is cylindrical in shape.

4. The bowstring suppressor of claim 3 wherein the plurality of resilient elements are constructed from an elastomeric material, wherein the plurality of resilient elements at least partially deform in shape so that an outer periphery of each of the resilient elements at least partially frictionally engages the inner bore as the push rod moves relative to the housing.

5. The bowstring suppressor of claim 1 comprising a retainer element joined with the second end of the push rod.

6. The bowstring suppressor of claim 5 wherein the retainer element includes a contact portion that contacts at least one of the plurality of resilient elements, wherein the contact portion corresponds in shape to the shape of the at least one of the plurality of resilient elements.

7. A bowstring suppressor assembly for an archery bow comprising:

a housing including a first housing end and a second housing end, the housing capable of being joined with the archery bow;

a plurality of resilient elastomeric elements positioned adjacent one another, the plurality of resilient elastomeric elements being located between the first housing end and the second housing end;

a push rod telescopically joined with the housing, the push rod including a first push rod end and a second push rod end, the second push rod end being located proximal at least one of the plurality of resilient elastomeric elements and being and adapted to move toward the plurality of resilient elements and to compress the plurality of resilient elements; and an engagement element joined with the first push rod end, the engagement element adapted to face a bowstring of the archery bow and to be engaged by the bowstring, wherein when the bowstring moves, the bowstring moves the push rod relative to the housing to at least partially compress at least one of the plurality of resilient elements, whereby compression of the at least one of the plurality of resilient elements provides at least one of energy absorption, vibration absorption and dampening in relation to energy generated by the bow when shooting an arrow from the bow.

8. The bowstring suppressor assembly of claim 7 comprising a retainer element joined with the push rod, the retainer element adapted to retain at least a portion of the push rod in the housing and to prevent disconnection of the push rod and the housing.

9. The bowstring suppressor assembly of claim 7 wherein the plurality of resilient elastomeric elements are constructed from at least one of rubber, elastomeric rubbers, elastic polymers, vinyl polymers, rubber copolymers, polyurethane, visceoelastic rubber, ethylene-propylene-diene rubbers, chlorinated rubbers, nitrile rubbers, methylmethacrylate styrene-butadiene block copolymers, polybutadiene, acrylonitrile-butadiene-styrene copolymers, rubber acrylic polymers, silicone and polymeric materials.

10. The bowstring suppressor assembly of claim 9 comprising a bushing positioned between the push rod and the housing.

11. The bowstring suppressor assembly of claim 7 comprising a mounting element joined with the housing, the mounting element adapted to join the housing with the archery bow.

12. The bowstring suppressor assembly of claim 11 wherein the mounting element and the housing are telescopically joined with one another so that a length of the suppressor assembly can be adjusted by a user moving the mounting element relative to the housing.

13. The bowstring suppressor assembly of claim 12 comprising a locking element that engages at least one of the mounting element and the housing to secure the housing and mounting element in a fixed spatial relationship relative to one another, whereby the suppressor assembly can be customized to fit the archery bow.

14. The bowstring suppressor assembly of claim 12 wherein the housing at least partially fits within the mounting element.

15. A bowstring suppressor for an archery bow comprising:

a suppressor assembly adapted to be joined with an archery bow, the suppressor assembly including an engagement element defining a recess adapted to face a bowstring of the archery bow, the engagement element adapted to be engaged by the bowstring;

a string attachment element joined with the bowstring, the string attachment element aligned with the engagement element so that when the archery bow is shot, the string attachment element moves toward, at least partially seats within, and at least partially deforms the engagement element, wherein the seating of the string attachment element at least partially within the engagement element at least partially restrains lateral and vertical movement of the bowstring.

16. The bowstring suppressor of claim 15 wherein the string attachment element defines a slot, wherein the slot is adapted to fit at least partially around the bowstring, wherein the string attachment element is fixedly joined with the bowstring to prevent movement of the string attachment element relative to the bowstring when the bowstring moves.

17. The bowstring suppressor of claim 15 wherein the recess is at least one of a concave, conical, frustoconical and cylindrical geometric configuration.

18. The bowstring suppressor of claim 15 wherein the engagement element includes a first end and a second end, wherein the recess is formed in the first end, wherein the recess includes a bottom, wherein the engagement element includes a solid cross section between the bottom of the recess and the first end.

19. The bowstring suppressor of claim 15 wherein the suppressor assembly includes a plurality of elastomeric resilient members positioned in a housing, wherein the engagement member translates movement of the bowstring to at least partially compress at least one of the plurality of resilient elements, whereby compression of the at least one of the plurality of resilient elements provides at least one of energy absorption, vibration absorption and dampening in relation to energy generated by the bow when shooting an arrow from the bow.

20. The bowstring suppressor of claim 15 wherein the engagement element mounts to a rod of the suppressor assembly, wherein the engagement element is of a solid cross section between the rod and a forward-most portion of the recess.

* * * * *